US008616171B2

(12) United States Patent
Kiani

(10) Patent No.: US 8,616,171 B2
(45) Date of Patent: Dec. 31, 2013

(54) VALVE SYSTEM FOR PISTON ENGINES

(76) Inventor: Afshin Kiani, Tehran (IR)

( * ) Notice: Subject to any disclaimer, the term of this patent is extended or adjusted under 35 U.S.C. 154(b) by 470 days.

(21) Appl. No.: 12/901,533

(22) Filed: Oct. 10, 2010

(65) Prior Publication Data

US 2012/0085311 A1 Apr. 12, 2012

(51) Int. Cl.
*F01L 7/00* (2006.01)

(52) U.S. Cl.
USPC ..... 123/190.1; 123/190.2; 123/80 R; 123/296

(58) Field of Classification Search
USPC ..... 123/190.1, 190.2, 190.4, 190.5, 190.6, 123/190.8, 296, 300, 305, 80 R, 80 BB, 123/80 BA
See application file for complete search history.

(56) References Cited

U.S. PATENT DOCUMENTS

| | | | | | |
|---|---|---|---|---|---|
| 1,492,586 | A * | 5/1924 | Toth | 123/59.1 |
| 1,724,275 | A * | 8/1929 | Gerin | 123/190.2 |
| 2,809,621 | A * | 10/1957 | Layne | 123/296 |
| 4,201,174 | A * | 5/1980 | Vallejos | 123/188.4 |
| 4,351,298 | A * | 9/1982 | Franke | 123/25 E |
| 4,556,023 | A * | 12/1985 | Giocastro et al. | 123/190.2 |
| 4,574,749 | A * | 3/1986 | Negre | 123/80 R |
| 5,249,553 | A * | 10/1993 | Guiod | 123/41.4 |
| 5,372,104 | A * | 12/1994 | Griffin | 123/190.2 |
| 5,572,967 | A * | 11/1996 | Donaldson, Jr. | 123/190.12 |
| 5,967,108 | A * | 10/1999 | Kutlucinar | 123/190.6 |
| 6,293,242 | B1 * | 9/2001 | Kutlucinar | 123/190.6 |
| 6,308,677 | B1 * | 10/2001 | Bohach et al. | 123/190.1 |
| 6,634,333 | B2 * | 10/2003 | Fujieda et al. | 123/308 |
| 6,763,788 | B2 * | 7/2004 | Wallis | 123/80 BA |
| 7,111,603 | B1 * | 9/2006 | Davis | 123/190.12 |
| 7,140,342 | B1 * | 11/2006 | Murray | 123/190.1 |
| 7,721,689 | B2 * | 5/2010 | Dirker | 123/80 R |
| 2003/0106517 | A1 * | 6/2003 | Trentham | 123/190.8 |
| 2006/0254554 | A1 * | 11/2006 | Zajac et al. | 123/190.12 |
| 2007/0151538 | A1 * | 7/2007 | Zajac et al. | 123/190.12 |

* cited by examiner

*Primary Examiner* — Noah Kamen
*Assistant Examiner* — Grant Moubry
(74) *Attorney, Agent, or Firm* — Barry Choobin; Patent 360 LLC

(57) ABSTRACT

The various embodiments of the present invention provide a rotary valve system for piston engines. The valve system for piston engines comprises an intake rotary valve, an exhaust rotary valve arranged in conjunction with the intake rotary valve, a crankshaft gear and a plurality of spindle gears. The plurality of spindle gears are connected to at least one of the intake rotary valve and the exhaust rotary valve to transfer a rotary force from the crankshaft gear to at-least one of the intake rotary valves and exhaust rotary valves such that intake rotary valve and the exhaust rotary valve are set in motion. The valve system provides for changing the volume and timing for entering the fuel and the air into the engine and exiting smoke from the engine. The rotary valve system decreases shake of the engine and performs the required performance of the engine within specified range.

16 Claims, 15 Drawing Sheets

VALVE SYSTEM FOR PISTON ENGINES

BACKGROUND

1. Technical Field

The embodiments herein generally relate to piston engines and particularly relate to a cylinder head of the piston engines. The embodiments herein more particularly relates to a rotary valve system in the cylinder head of the piston engines.

2. Description of the Related Art

Conventional internal combustion engines used in cars, trucks, motorcycles, aircraft, construction machinery and in many others, most commonly use a four-stroke cycle. The four strokes refer to an intake, compression, combustion (power) and exhaust strokes that occur during two crankshaft rotations per working cycle of a gasoline engine or a diesel engine. The cycle begins at Top Dead Center (TDC), when the piston is farthest away from the axis of the crankshaft. A stroke refers to the travel of the piston from Top Dead Center (TDC) to Bottom Dead Center (BDC).

During an intake stroke or induction stroke of a piston, the piston descends from the top of the cylinder to the bottom of the cylinder, reducing a pressure inside the cylinder. A mixture of fuel and air is forced into the cylinder through the intake port at a pressure equal to or greater than the atmospheric pressure thereby enabling the closure of the intake valve. During a compression stroke, both the intake valve and the exhaust valves are closed and the piston returns to the top of the cylinder compressing the fuel-air mixture. During the combustion stroke, the piston is pushed close to the Top Dead Center and the compressed air-fuel mixture is ignited usually by a spark plug (for a gasoline or Otto cycle engine) or by the heat and pressure of compression (for a diesel cycle or compression ignition engine). The resulting massive pressure from the combustion of the compressed fuel-air mixture drives the piston back down towards the bottom dead center with tremendous force. This is known as the power stroke, which is the main source of the engine's torque and power. During the exhaust stroke, the piston once again returns to top dead center while the exhaust valve is opened. This action evacuates the products of combustion from the cylinder by pushing the spent fuel-air mixture through the exhaust valve (s).

In the existing methods, the cams are opened and closed with the rotation of a camshaft via stroke to valves, which in turn creates considerable shake in the engine. As the operation time of the engine increases, the level of shake in the engine will also increase, thereby necessitating a periodical regulation. Further, the shaking will increase the fuel consumption in piston engines. The existing engines include a large number of components which cause an increase in the weight, thereby creating an influence on the designing and construction of the engine and create higher complexity. Moreover, due to the fixed size of the valves in the present engines there is no possibility to create a variety in the entrance and exit of the engines.

The abovementioned shortcomings, disadvantages and problems are addressed herein and which will be understood by reading and studying the following specification.

OBJECTS OF THE EMBODIMENTS

The primary object of the embodiments herein is to provide a rotary valve system for the piston engines.

Another object of the embodiments herein is to provide a rotary valve system is to reduce the shake movement in the engines.

Another object of the embodiments herein is to provide a rotary valve system is to reduce the fuel consumption.

Another object of the embodiments herein is to provide a rotary valve system to moderate the volume of fuel or air entering into the engine.

Another object of the embodiments herein is to provide a rotary valve system which moderates the volume of smoke that exit from the engine.

Yet another object of the embodiments herein is to provide a rotary valve system which is simple in design.

Yet another object of the embodiments herein is to provide a rotary valve system which is easy to assemble and dissemble.

These and other objects and advantages of the embodiments herein will become readily apparent from the following detailed description taken in conjunction with the accompanying drawings.

SUMMARY

The various embodiments herein provide a valve system for rotary valves of piston engines. The valve system is also designed for a cylinder head in any kind of engine. The cylinder head is modified in such a manner that the piston engines are equipped with the technology of the rotary valve system. According to an embodiment, a rotary valve system for the piston engines comprises an intake rotary valve, an exhaust rotary valve arranged in conjunction with the intake rotary valve, a crankshaft gear and a plurality of spindle gears. The plurality of spindle gears are connected to at least one of the intake rotary valve and the exhaust rotary valve to transfer a rotary force from the crankshaft gear to at-least one of the intake rotary valves and exhaust rotary valves such that the intake rotary valve and the exhaust rotary valve are set in motion.

According to an embodiment, the intake rotary valve assembly of the rotary valve system comprises an intake rotary valve pipe, a plurality of intake rotary valve holes drilled in the intake rotary valve pipe along the length of the valve pipe, an intake rotary valve well, a plurality of intake rotary valve well holes provided in the intake rotary valve well, an injector pipe and a plurality of injector nozzles. The intake rotary valve well is a lengthwise cavity drilled into a cylinder head of the piston engine and extended along the length of the pipe.

According to an embodiment, the intake rotary valve includes the intake rotary valve pipe consisting of four holes (one hole per cylinder) called intake rotary valve holes with a distance equivalent to the cylinders of the engine. The intake rotary valve holes are drilled on the intake rotary valve pipe with different angles based on the valve timing. The intake rotary valve pipe is then connected to the crankshaft gear via the intake rotary valve gear by one of the two spindle gears. The intake rotary valve gear is connected with the exhaust rotary valve gear such that the intake rotary valve gear transfers the rotary motion to the exhaust rotary valve gear, thereby rotating the exhaust rotary valve gear. The intake rotary valve pipe is arranged inside of the intake rotary valve well. The intake rotary valve well includes four holes, called the intake rotary valve well holes, drilled along its length. The intake rotary valve rotates the intake rotary valve well at an angle of the intake rotary valve holes. The intake rotary valve holes are placed opposite to the intake rotary valve well holes such that the inlet path for admitting fuel and air of each cylinder will be opened. Each of the rotary valve injector nozzles is placed opposite to the intake rotary valve well holes located on the injector pipe provided inside of the intake rotary valve and the operation of spraying the fuel into the cylinders is carried out upon opening the path.

According to an embodiment herein, the exhaust rotary valve assembly of the valve system for piston engines comprises an exhaust rotary valve pipe, a plurality of exhaust rotary valve holes provided inside the exhaust rotary valve pipe, an exhaust rotary valve well and a plurality of exhaust rotary valve well holes provided inside the exhaust rotary valve well. The exhaust rotary valve well is a lengthwise cavity drilled into a cylinder head of the piston engine and extended along the length of the pipe.

According to an embodiment herein, the exhaust rotary valve includes the exhaust rotary valve pipe consisting of four holes (one hole per cylinder) called the exhaust rotary valve holes with a distance equivalent to the cylinders of the engine. The exhaust rotary valve holes are drilled on the exhaust rotary valve pipe with different angles based on the valve timing. Exhaust rotary valve pipe is connected to the intake rotary valve gear and receives force from the intake rotary valve gear. The exhaust rotary valve pipe is arranged inside the exhaust rotary valve well consisting of four holes (one hole for each cylinder) called exhaust rotary valve well holes that makes the pipe to rotate. The rotation is based on the angle of each exhaust rotary valve hole. When the position of the exhaust rotary valve holes are arranged opposite to the exhaust rotary valve well holes, the exhaust path for smoke from one of the cylinders is opened.

According to an embodiment herein, the diameter of the intake rotary valve gear is double the diameter of crankshaft gear so that the intake rotary valve gear is rotated by one fourth to correspond to one stroke from the four main strokes including an intake stroke, a compression stroke, a power stroke and an exhaust stroke, during a half rotation of the crankshaft gear. Similarly the diameter of the exhaust rotary valve gear is equivalent to double the diameter of the crankshaft gear so that the exhaust rotary valve gear is rotated by one fourth to correspond to one stroke from the four main strokes including an intake stroke, a compression stroke, a power stroke and an exhaust stroke, during a half rotation of the crankshaft gear. The valve system as described in the embodiments herein can be used in any gasoline engines, gas engines besides an injection system in any kind of an engine with any number of cylinders.

BRIEF DESCRIPTION OF THE DRAWINGS

The other objects, features and advantages will occur to those skilled in the art from the following description of the preferred embodiment and the accompanying drawings in which.

Figure 1:
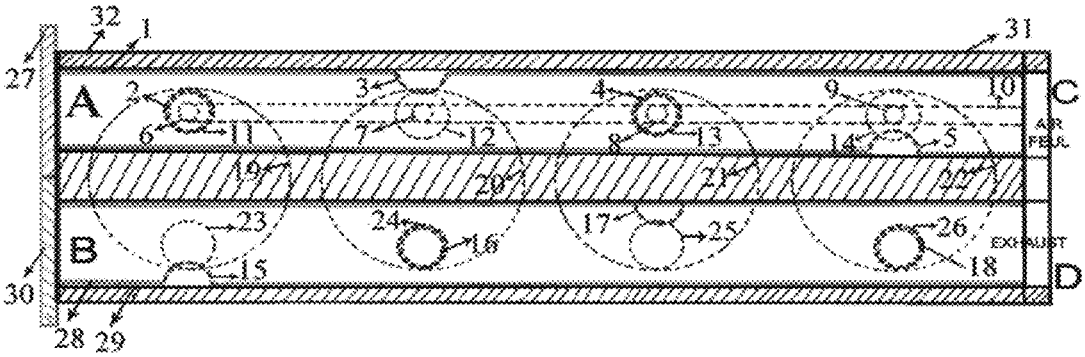
FIG. 1 illustrates a sectional top view of a cylinder head of a piston engine with a rotary valve system, according to one embodiment herein.

Although the specific features of the embodiments herein are shown in some drawings and not in others. This is done for convenience only as each feature may be combined with any or all of the other features in accordance with the embodiments herein

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments of the present disclosure provide a rotary valve system for the rotary valves in the piston engines. The valve system for piston engines comprises an intake rotary valve, an exhaust rotary valve arranged in conjunction with the intake rotary valve, a crankshaft gear and a plurality of spindle gears. The plurality of spindle gears are connected to at least one of the intake rotary valve and the exhaust rotary valve to transfer a rotary force from the crankshaft gear to at-least one of the intake rotary valves and exhaust rotary valves such that intake rotary valve and the exhaust rotary valve are set in motion.

The intake rotary valve assembly of the valve system for piston engines comprises an intake rotary valve pipe, a plurality of intake rotary valve holes drilled in the intake rotary valve pipe along the length of the valve pipe, an intake rotary valve well, a plurality of intake rotary valve well holes provided in the intake rotary valve well, the injector pipe and a plurality of injector nozzles. The intake rotary valve well is a lengthwise cavity drilled into a cylinder head of the piston engine and extended along the length of the pipe.

The intake rotary valve includes the intake rotary valve pipe consisting of four holes (one hole per cylinder) called intake rotary valve holes drilled at a distance equal to that of the cylinders of the engine. The intake rotary valve holes are drilled on the intake rotary valve pipe with different angles based on the valve timing. The intake rotary valve pipe is then connected to the crankshaft gear via intake rotary valve gear by one of the two spindle gears for receiving a force. On the other hand, the intake rotary valve gear is connected with the exhaust rotary valve gear, to rotate the exhaust rotary valve gear. The intake rotary valve pipe is arranged inside of the intake rotary valve well, consisting of four holes (one hole for each cylinder) called intake rotary valve well holes that make them to rotate. The rotation is based on the angle of the intake rotary valve holes. The intake rotary valve holes are arranged opposite to the intake rotary valve well holes and the inlet path for admitting fuel and air of each cylinder is opened. Each of the rotary valve injector nozzles is placed opposite to the intake rotary valve well holes located on the injector pipe arranged inside of the intake rotary valve and the operation of spraying fuel into the cylinders is done upon opening the inlet path.

The exhaust rotary valve assembly of the valve system for piston engines comprises an exhaust rotary valve pipe, a plurality of exhaust rotary valve holes provided inside the exhaust rotary valve pipe, an exhaust rotary valve well and a plurality of exhaust rotary valve well holes provided inside the exhaust rotary valve well. The exhaust rotary valve well is a lengthwise cavity drilled into a head cylinder of the piston engine and extending along the length of the pipe.

The exhaust rotary valve includes the exhaust rotary valve pipe consisting of four holes (one hole per cylinder) called the exhaust rotary valve holes with distance equivalent to the cylinders of the engine. The exhaust rotary valve holes are drilled on the exhaust rotary valve pipe with different angles based on the valve timing. Exhaust rotary valve pipe is connected to the exhaust rotary valve gear which inturn is connected to the intake rotary valve gear. The exhaust rotary valve pipe is inside of the exhaust rotary valve well consisting of four holes (one hole for each cylinder) called exhaust rotary valve well holes that makes them to rotate. The rotation is based on the angle of each the exhaust rotary valve holes and the position of the exhaust rotary valve holes are arranged opposite to the exhaust rotary valve well holes and the exhaust path for ejecting smoke for one of the cylinders is opened.

According to an embodiment herein, the diameter of the intake rotary valve gear is double the diameter of crankshaft gear so that the intake rotary valve gear is rotated by one fourth to correspond to one stroke from the four main strokes including an intake stroke, a compression stroke, a power stroke and an exhaust stroke, during a half rotation of the crankshaft gear. Similarly the diameter of the exhaust rotary valve gear is double the diameter of the crankshaft gear so that the exhaust rotary valve gear is rotated by one fourth to correspond to one stroke from the four main strokes including an intake stroke, a compression stroke, a power stroke and an exhaust stroke, during a half rotation of the crankshaft gear. The valve system as described in the embodiments herein can be used in any gasoline engines, gas engines besides an injection system in any kind of an engine with any number of cylinders.

FIG. 1 illustrates a sectional top view of the head cylinder of the piston engine according to one embodiment of the present disclosure. The intake rotary valve A and the exhaust rotary valve B are placed inside the cavities in the head cylinder 31. Intake rotary valve A is provided with an intake rotary valve pipe 1 with 4 holes (one per cylinder) with distance equivalent to the cylinders of an engine and the intake rotary valve holes 2, 3, 4,5 are drilled at different angles based on valve timing. The intake rotary valve pipe 1 is connected to the crankshaft gear via the intake rotary valve gear 27 by one of two spindle gears and the intake rotary valve gear 27 receives a rotary force. On the other hand, the intake rotary valve 27 is involved with the exhaust rotary valve gear 30 and rotates it. The intake rotary valve pipe 1 is inside of intake rotary valve well 32 that has 4 holes (one hole per cylinder) called intake rotary valve well holes 11, 12, 13 14 that makes the rotary valve well 32 to rotate. The rotation is based on an angle of intake rotary valve holes 2, 3, 4, 5. When the intake rotary valve holes 2, 3, 4, 5 are arranged opposite to the intake rotary valve well holes 11, 12, 13, 14, the inlet path for admitting the fuel and the air for each cylinder is opened. Each of the rotary valve injector nozzles 6, 7, 8, 9 is positioned opposite to the intake rotary valve well holes 11, 12, 13, 14 and located on the injector pipe 10 inside of the intake rotary valve A as shown in FIG. 1.

The exhaust rotary valve B has an exhaust rotary valve pipe 29 with 4 exhaust rotary valve holes 15, 16, 17, 18 which are drilled with distances equivalent to the cylinders of the engine with different angles based on the valve timing. Exhaust rotary valve pipe 28 is involved with an exhaust rotary valve gear 30 which is engaged to the intake rotary valve gear 27 to receive a force from it. Exhaust rotary valve pipe 28 is arranged inside of the exhaust rotary valve well 29 that has 4 exhaust rotary valve holes 15, 16, 17,18 (one hole per cylinder) to rotate them. The rotation is based on the angle of each exhaust rotary valve holes 15, 16, 17, 18. The exhaust path for smoke from one of the cylinders is opened, when the angle of each exhaust rotary valve holes 15, 16, 17, 18 is positioned opposite to the exhaust rotary valve well holes 23, 24, 25, 26. The arrangement of the exhaust rotary valve well 29, the exhaust rotary valve well holes 15, 16, 17,18 and the smoke emitted from the exhaust port D of engine, is shown in FIG. 1.

Figure 2:
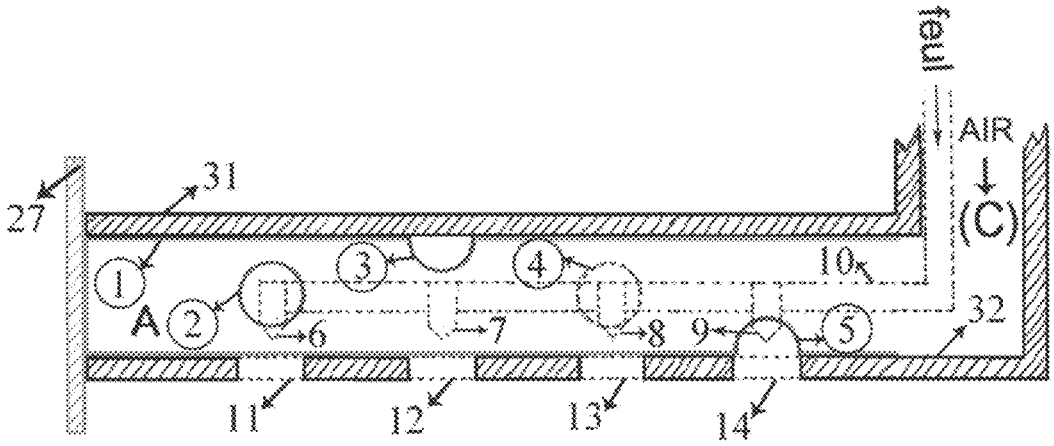
FIG. 2 illustrates a longitudinal sectioned view of an intake rotary valve in a rotary valve system for a piston engine, according to one embodiment herein.

FIG. 2 illustrates the longitudinal sectioned view of the intake rotary valve, showing the air and the fuel entrance port according to one embodiment of the present disclosure. FIG. 2 shows the intake rotary valve pipe 1 with 4 intake rotary valve holes 2, 3, 4, 5, intake rotary valve gear 27 and cavity of head cylinder 31 in which the intake rotary valve A is rotating. The rotating intake rotary valve A is called intake rotary valve well 32 and holes inside of the intake rotary valve well are called intake rotary valve well holes 11, 12, 13, 14. Besides the intake rotary valve well holes 11, 12, 13, 14, the intake rotary valve A includes the intake rotary valve injector nozzle pipe 10, intake rotary valve nozzles 6, 7, 8, 9, air passage and injector nozzle pipe C through which air and fuel enters into intake rotary valve A.

Figure 3:
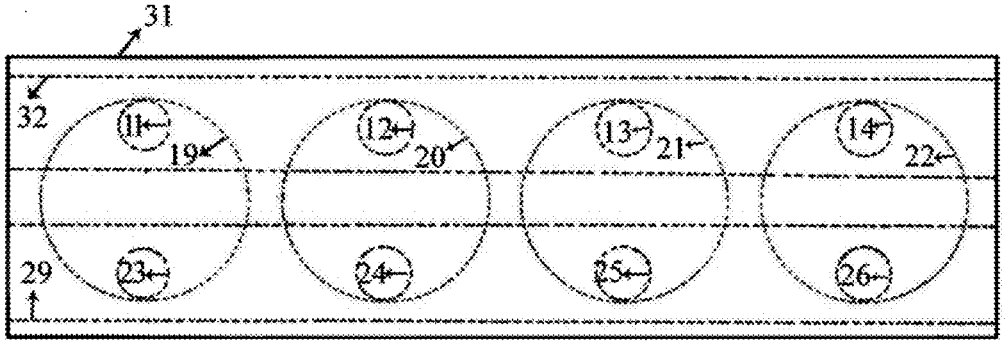
FIG. 3 illustrates a schematic top view of a cylinder head of a piston engine with a rotary valve system, according to one embodiment herein.

FIG. 3 illustrates the top perspective view of the cylinder head showing the cylinders, intake and exhaust rotary valve wells and intake and exhaust rotary valve well holes according to one embodiment of the present disclosure. As shown in FIG. 3, two cavities extending lengthwise are provided in the head cylinder. The first cavity is the intake rotary valve well 32, where the intake rotary valve well is provided with dimensions to cause the rotation of the intake rotary valve A. There are 4 intake rotary valve well holes 11, 12, 13, 14 provided along the length of intake rotary valve well 32, as shown in FIG. 1 for the entry of fuel and air to the cylinders 19, 20, 21, 22. The second lengthwise cavity is the exhaust rotary valve well 29. The dimension of the exhaust rotary valve well 29 permits the rotation of the exhaust rotary valve B inside the exhaust rotary valve well 29. At one side of the exhaust rotary valves well 29, four rotary valve well holes 23, 24, 25, 26 are drilled at a distance equivalent to the distance of the cylinders such that the rotary valve well holes 23, 24, 25, 26 get aligned with the cylinders for exhausting the smoke from one of the open cylinder.

Figure 4:
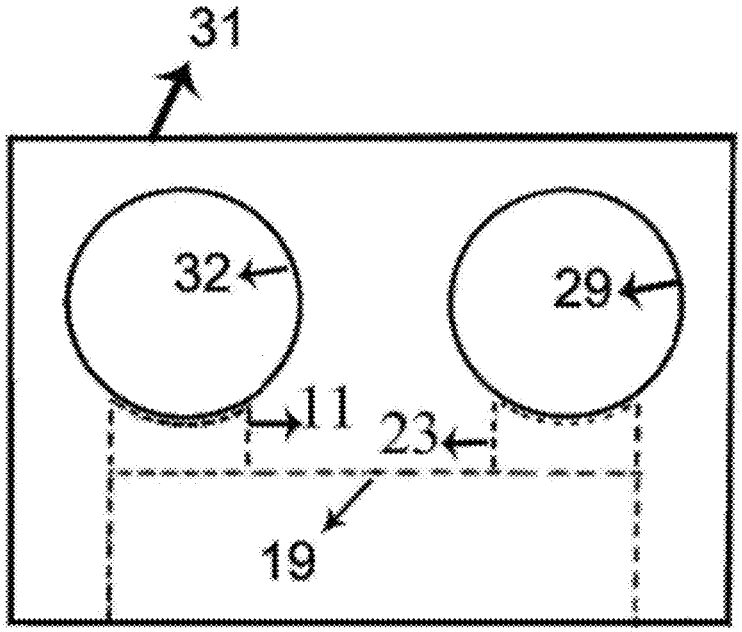
FIG. 4 illustrates a schematic front view of a head cylinder head showing the cylinders, intake rotary valve wells, exhaust rotary valve wells, intake rotary valve well holes and exhaust rotary valve well holes, in a rotary valve system according to one embodiment herein.

FIG. 4 illustrates the front perspective view of the cylinder head showing the cylinder, intake and exhaust rotary valve wells and intake and exhaust rotary valve well holes according to one embodiment of the present disclosure. The cross section of the head cylinder 31 shows the cavity of the intake rotary valve well 32, the cavity of the exhaust rotary valve well 29, the intake rotary valve hole 11, exhaust rotary valve hole 23 and the cylinder 19. The intake rotary valve well 32 and the exhaust rotary valve well 29 are the two lengthwise holes provided in the cylinder head 31. The intake rotary valve well hole 11 is placed inside the cylinder 19 and permits the entry of fuel and air to the cylinder 19. Similarly, the exhaust rotary valve well hole 23 is placed inside the cylinder 19 for exhausting smoke from the cylinder 19.

Figure 5:
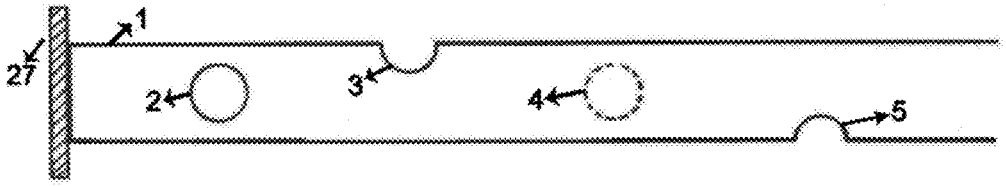
FIG. 5 illustrates a schematic sectional view of the intake rotary valve pipe along with the intake rotary valve holes of the piston engine showing the connection of intake rotary valve to the intake rotary valve gear in a rotary valve system according to one embodiment herein.

FIG. 5 illustrates the sectional view of the intake rotary valve pipe along with the intake rotary valve holes of the piston engine showing the connection of intake rotary valve to the intake rotary valve gear according to one embodiment of the present disclosure. The piston engine rotary valves consist of an intake rotary valve pipe 1 with a length nearly equal to the length of a cylinder head and with a diameter based on the volume of the engine. Along the length of the pipe, a plurality of intake rotary valve holes 2, 3, 4, 5 are drilled with different angles based on the timing of the engine. The diameter and size of the drilled intake rotary valve holes 2, 3, 4, 5 provided in intake rotary valve pipe 1 of rotary valve effectively adjusts the level and time of entering fuel, air and exhausting smoke (based on type of intake rotary valve or exhaust rotary valve). The intake rotary valve is connected to the intake rotary valve gear wheel 27 so that it will be moved with related to a crankshaft as shown in FIG. 5.

Figure 6:
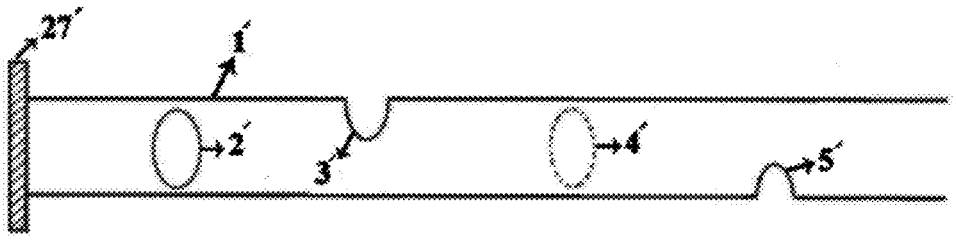
FIG. 6 illustrates a schematic sectional view of the intake rotary valve pipe along with the intake rotary valve holes of different shapes in a rotary valve system according to one embodiment herein.

FIG. 6 illustrates the sectional view of the intake rotary valve pipe along with the intake rotary valve holes of different shapes and showing the connection of intake rotary valve to the intake rotary valve gear according to one embodiment of the present disclosure. The piston engine rotary valves in accordance to FIG. 6, consist of intake rotary valve pipe 1 with a length nearly equal to length of the cylinder head and with a diameter based on the volume of the engine. Along the length of intake rotary valve pipe 1, there are intake rotary valve holes 2, 3, 4, 5 of oval shape with different angles based on timing of the engine. The diameter and the size of the drilled intake rotary valve holes 2, 3, 4, 5 of oval shape in intake rotary valve pipe 1 of rotary valve is effective on level and time of entering fuel, air and exiting smoke (based on type of intake rotary valve or exhaust rotary valve). The intake rotary valve is connected to the intake rotary valve gear wheel 27 so that it will be moved with related crankshaft as shown in FIG. 6. The intake rotary valve holes can be drilled in different sizes and shapes like oval, hyperbola and the like as shown in FIG. 6.

Figure 7:
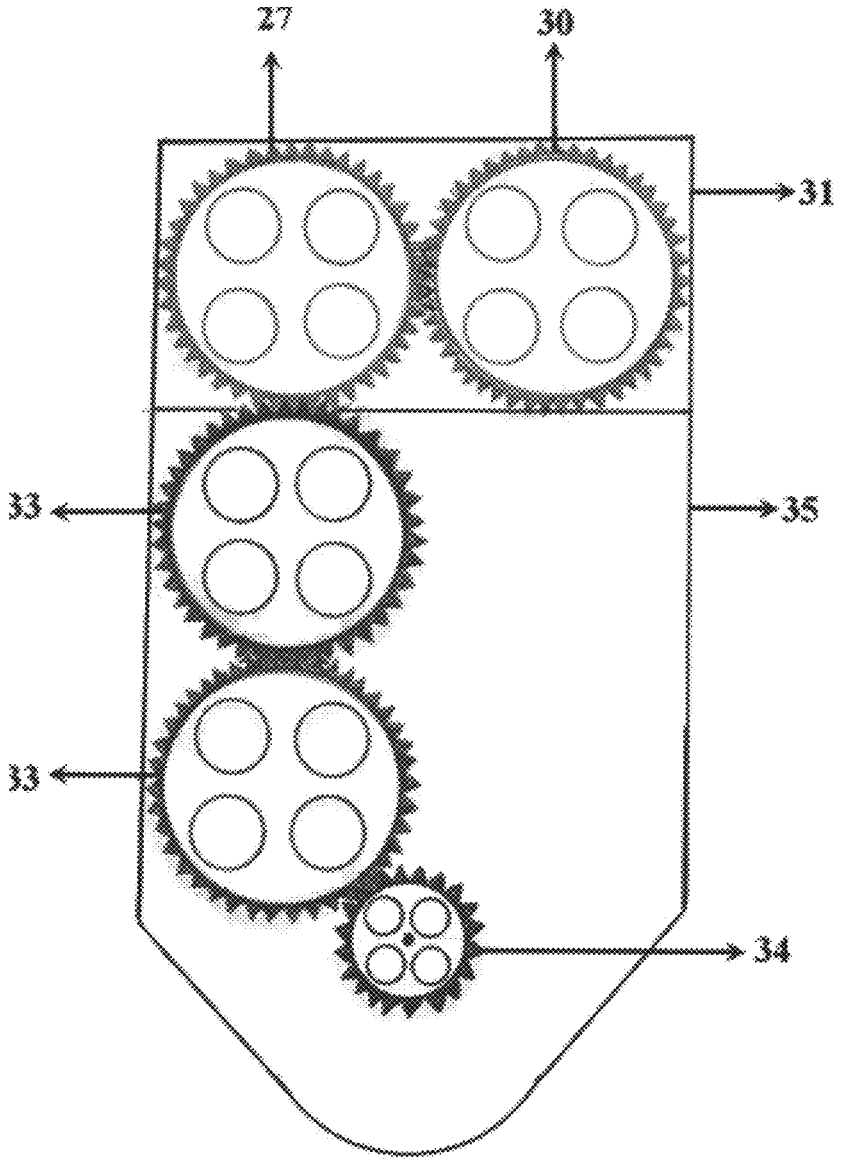
FIG. 7 illustrates a cross sectional view of the piston engine provided with a rotary valve system, showing the connection of rotary valve gears and the crankshaft gear, according to one embodiment herein.

FIG. 7 illustrates the cross sectional view of the piston engine showing the connection of rotary valve gears and the crankshaft gear according to one embodiment of the present disclosure. The cylinder head of the piston engines consists of the intake rotary valve gear 27 and the exhaust rotary valve gear 30 connected together based on valve timing. The intake rotary valve gear 27 is singly connected and involved to crankshaft 34 via two spindle gears 33 inside the engine case as shown in FIG. 7. In order to perform the engine valve timing, the diameter of the crankshaft gear 34 is half of the intake rotary valve gear 27 and the diameter of the exhaust rotary valve gear 30 is similar to the diameter of the intake rotary valve gear 27. The half round rotation of the crankshaft gear 34 leads to one fourth rotation of both the intake rotary valve gear 27 and the exhaust rotary valve gear 30 completing one stroke of the each cylinder. Therefore 4 strokes (intake, compression, ignition and exhaust) are performed upon one complete rotation of both intake rotary valve gear 27 and the exhaust rotary valve gear 30 and two rotations of the crankshaft gear 34.

When the crankshaft gear 34 rotates through a half round, the intake rotary valve gear 27 rotates through one fourth completing the one stroke such as an intake stroke of each cylinder. Four strokes of the engine include intake, compression, power and exhaust strokes. The four strokes are performed within two complete rotations of the crankshaft gear 34 and one complete rotation of the intake rotary valve gear 27. Therefore the diameter of the intake rotary valve gear 27 is double the size of the crankshaft gear 34 so that the other 3 strokes such as compression stroke power stroke, exhaust stroke are performed by one fourth of rotation of intake rotary valve A. In the three of the aforesaid strokes, the intake rotary valve A is rotated further in steps of one fourth of a cycle to block the paths for entering fuel and air, i.e., intake rotary valve well holes 11, 12, 13 14. The stage of next intake stroke is started only when intake rotary valve holes 2, 3, 4, 5 are again aligned with the intake rotary valve well holes 11, 12, 13, 14 such that the alignment permits the entering and exiting of the fuel and air at each of the four cylinders 39, 40, 41, 42. Since the four holes of the intake rotary valve holes 2, 3, 4, 5 are drilled on the intake rotary valve A based on the valve timing, each of them are moved by one fourth rotation of intake rotary valve A for positioning opposite to the intake rotary valve well holes 11, 12, 13, 14 during an intake stroke of each cylinder and the path for injecting fuel and air is opened.

Figure 8:
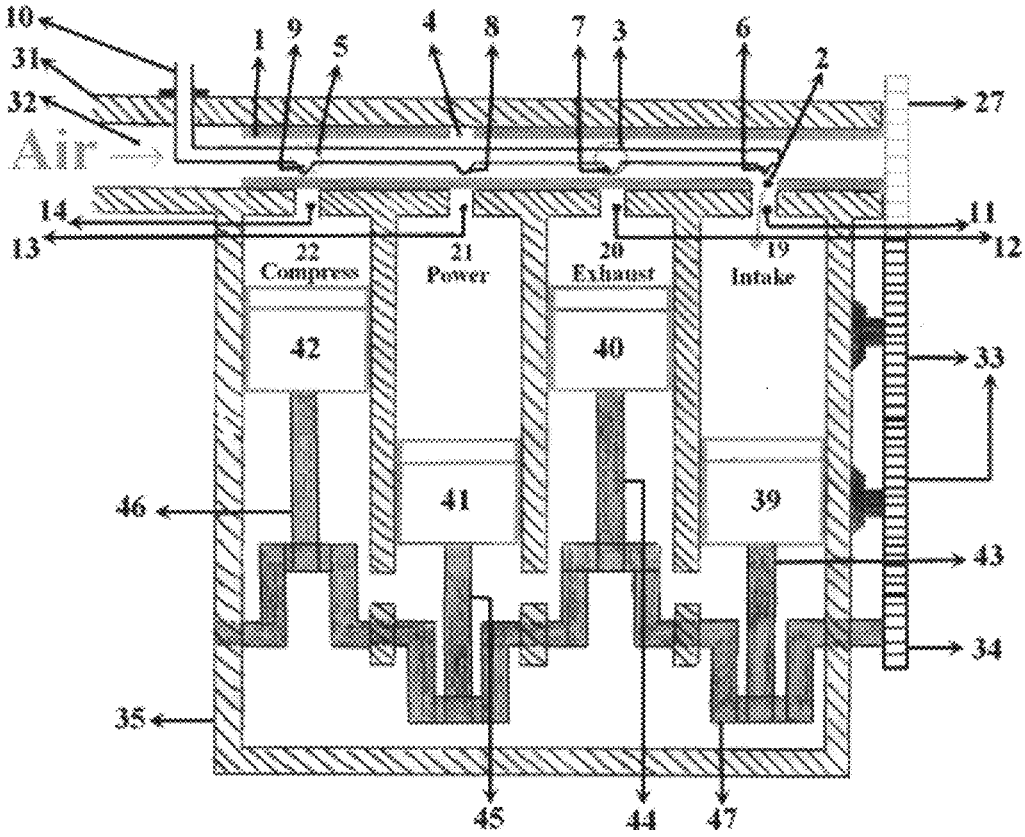
FIG. 8 illustrates a cross sectional view of the piston engine provided with a rotary valve system and the intake rotary valve, when one cylinder is in an intake stroke and the intake rotary valve is rotated by one fourth to keep one of the intake rotary valve well holes in open condition to align with the cylinder in intake stroke, according to one embodiment herein.

FIG. 8 illustrates the cross sectional view of the piston engine showing the intake rotary valve with the cylinder in intake stroke, wherein one of the intake rotary valve well hole is in open condition, according to one embodiment of the present disclosure. In FIG. 8, the piston 39 is raised and the cylinder 19 is at the intake stroke mode. As a result, the crankshaft 47 causes a half rotation of the crankshaft gear 34 and the rotation by spindle gears 33 is transferred to the intake rotary valve gear 27. The diameter of the intake rotary valve gear 27 is double the size of the crankshaft gear 34 and hence is rotated by one forth and consequently intake rotary valve A is also rotated by one fourth. The intake rotary valve hole 2 is located opposite to the intake rotary valve well holes 11. The path for admitting the air into the intake rotary valve A and the fuel from the injector nozzle 6 is opened inside of the cylinder 19 and intake stroke is completed. Meanwhile the other intake rotary valve holes 3, 4, 5 are at an angle related to the other strokes. For example, the piston 40 is raised in the cylinder 20 and the operation of the exhaust stroke is executed. Thus intake rotary valve hole 3 is located at a position corresponding to one fourth of its rotation of an intake rotary valve A before completing the rotation of the intake stroke and consequently intake rotary valve well hole 12 is closed. Similarly, the intake rotary valve hole 4 is located at a position corresponding to two fourth of its rotation before intake stroke stage and complete rotation of intake rotary valve A, closing the intake rotary valve well hole 13. In the cylinder 22, the piston is raised and it is at the compression stroke stage. The intake rotary valve hole 5 is located at a position corresponding to three fourth rotation stage after the intake stroke completes the rotation of the intake rotary valve A. Therefore the path for the fuel and the air is opened only for the cylinder 19 as shown in FIG. 8 and the path for the fuel and the air is closed for other cylinders which are in the other strokes.

Figure 9:
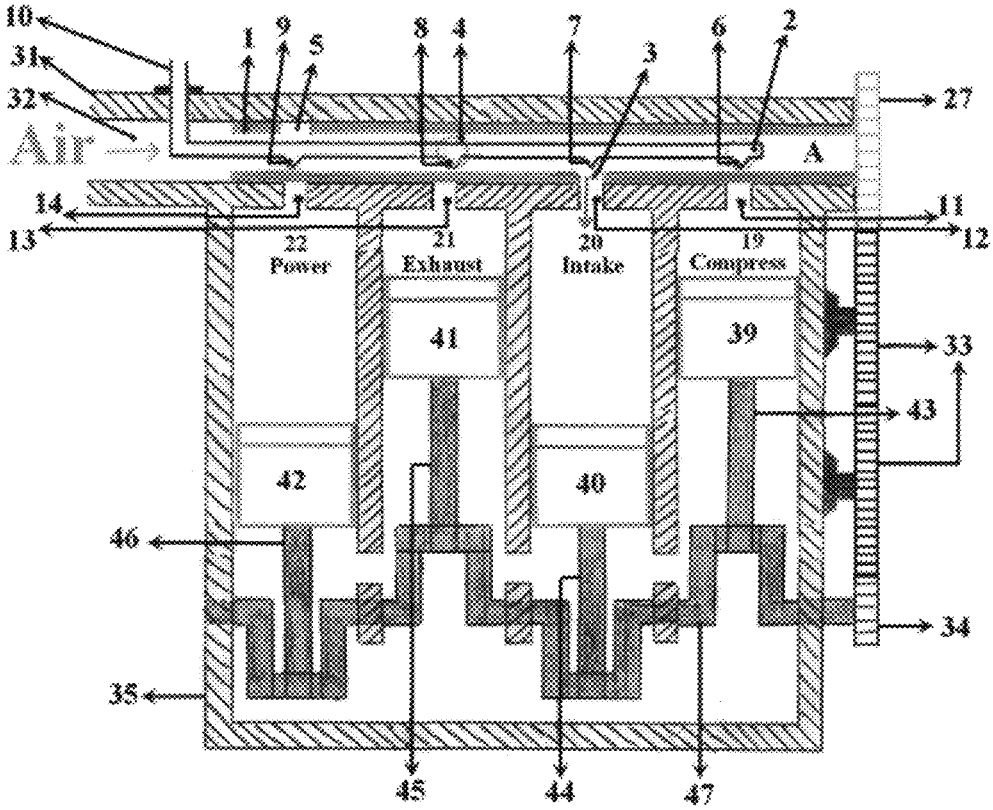
FIG. 9 illustrates a cross sectional view of the piston engine provided with a rotary valve system and the intake rotary valve, when another cylinder is in an intake stroke and the intake rotary valve is rotated by two fourth to keep one of the intake rotary valve well holes in open condition to align with the cylinder in intake stroke, according to one embodiment herein.

FIG. 9 illustrates the cross sectional view of the piston engine showing the intake rotary valve with cylinder in intake stroke, wherein one of the intake rotary valve well hole is in open condition, according to one embodiment of the present disclosure. With respect to FIG. 9, the cylinder 19 is in the compression stroke. The intake rotary valve hole 2 is located at one fourth of the rotation after the intake stroke at complete rotation of intake rotary valve A and intake rotary valve well hole 11 is closed. The cylinder 20 is at the intake stroke stage and the intake rotary valve hole 3 is located opposite to the intake rotary vale well hole 12 and the path for entering fuel from injection nozzle 7 and the air from the intake rotary valve A is opened. The cylinder 21 is at the exhaust stroke and the intake rotary valve hole 4 is at a position corresponding to two fourth or one half of its rotation before the intake stroke completes the rotation of the intake rotary valve A and the intake rotary valve well hole 13 is closed. The piston 42 is located at the bottom side and the cylinder 22 is at the power stroke. At this stage, the intake rotary valve hole 5 is at a position corresponding to three fourth of its rotation before the intake stroke completes the rotation of intake rotary valve A. Therefore the intake rotary valve well hole 14 is closed.

Figure 10:
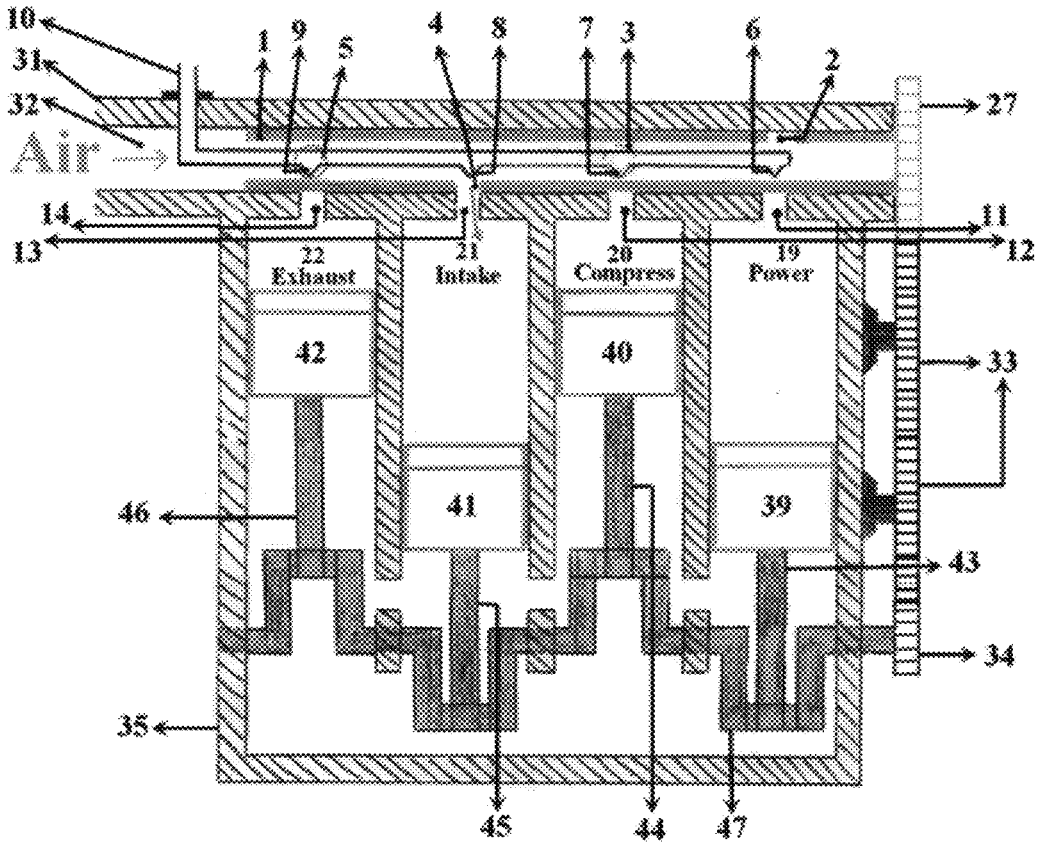
FIG. 10 illustrates a cross sectional view of the piston engine provided with a rotary valve system and the intake rotary valve, when another cylinder is in an intake stroke and the intake rotary valve is rotated by three fourth to keep one of the intake rotary valve well holes in open condition to align with the cylinder in intake stroke, according to one embodiment herein.

FIG. 10 illustrates the cross sectional view of the piston engine showing the intake rotary valve with cylinder in intake stroke, wherein one of the intake rotary valve well hole is in open condition, according to one embodiment of the present disclosure In the FIG. 10, the piston 39 is raised and the cylinder 19 is at the power stroke. The intake rotary valve hole 2 is at a position corresponding to one half or two fourth of its rotation before the intake stroke completes a rotation of the intake rotary valve A. Therefore the intake rotary valve well hole 11 is closed. The piston 40 is raised and the cylinder 20 is at the compression stroke mode. The intake rotary valve hole 3 is at a position corresponding to three fourth of its rotation after the intake stroke completes the rotation of intake rotary valve A. Therefore the intake rotary valve well hole 12 is closed. The piston 41 will go down and the cylinder 21 is at the intake stroke mode. The intake rotary valve hole 4 is located opposite to the intake rotary valve well hole 13 and entrance of the fuel is possible from the intake rotary valve nozzle 8 and air from the intake rotary valve A. The piston 42 is raised and the cylinder 22 is at the exhaust stroke mode. The intake rotary valve hole 5 is one fourth of its rotation before an intake stroke, from completing the rotation of the intake rotary valve A and the intake rotary valve well hole 14 is closed.

Figure 11:
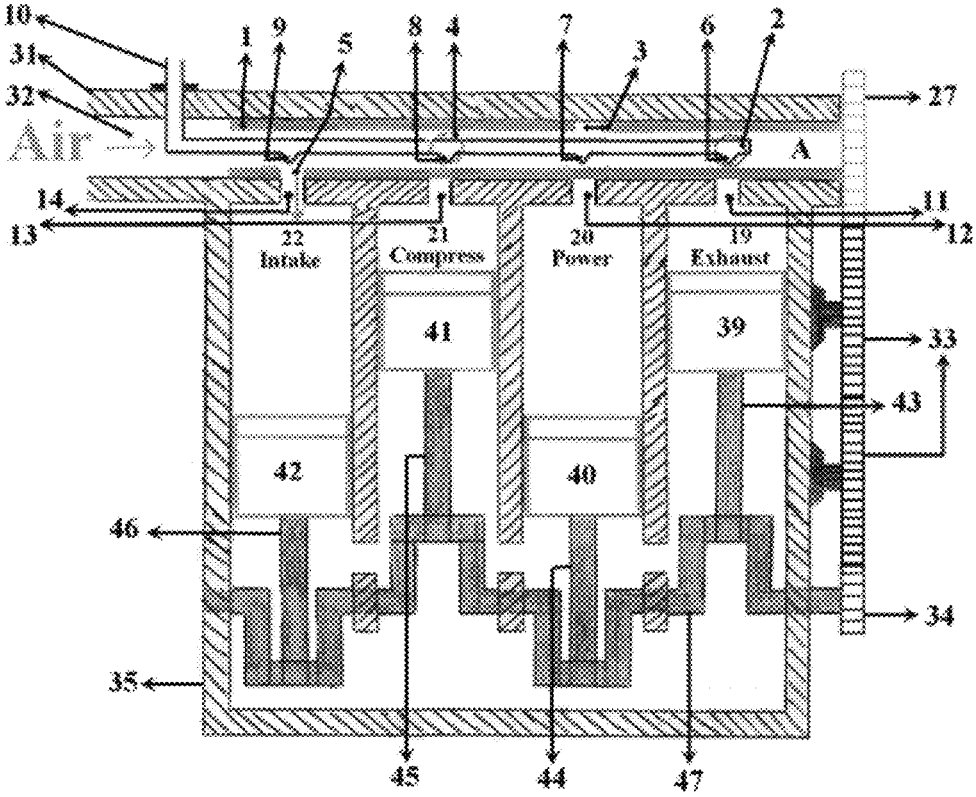
FIG. 11 illustrates a cross sectional view of a piston engine provided with a rotary valve system and the intake rotary valve, when another cylinder is in an intake stroke and the intake rotary valve is rotated by one cycle to keep one of the intake rotary valve well holes in open condition to align with the cylinder in intake stroke, according to one embodiment herein.

FIG. 11 illustrates the cross sectional view of the piston engine showing the intake rotary valve with cylinder in intake stroke, wherein one of the intake rotary valve well hole is open according to one embodiment of the present disclosure. In the FIG. 11 the piston 39 is raised and the cylinder 19 is at the exhaust stroke mode. The intake rotary valve hole 2 is at one fourth of its rotation before intake stroke from completing the rotation of the intake stroke A. Therefore the intake rotary valve well hole 12 is closed. The piston 40 will go down and the cylinder 20 is at the power stroke mode. The intake rotary valve hole 3 is at one second of its rotation before the intake stroke from completing the rotation of the intake rotary valve A and consequently the intake rotary valve well hole 12 is closed. The piston 41 is raised and the cylinder 21 is at the compression stroke mode. The intake rotary valve hole 4 is at one fourth of its rotation after the intake stroke from completing the rotation of the intake rotary valve A and consequently the intake rotary valve well hole 13 will be closed. The piston 42 will go down and the cylinder 22 is at the intake stroke mode. The intake rotary valve hole 5 is opposite to the intake rotary valve well hole 14 and path for entering the fuel from the injector nozzle 9 and air from the intake rotary valve A is opened. The rotary valve system can be used at any kinds of engines including old carburetor engines, gasoline engines or gas oil engines.

Figure 12:
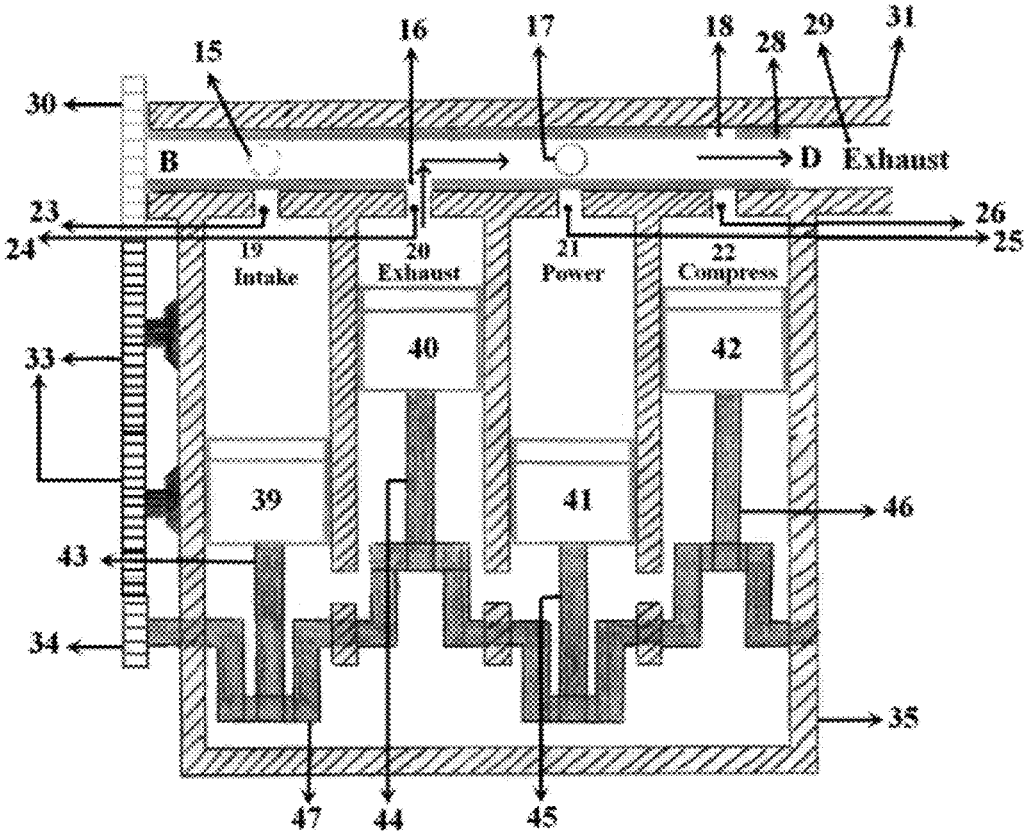
FIG. 12 illustrates a cross sectional view of a piston engine provided with a rotary valve system and the exhaust rotary valve, when one cylinder is in an exhaust stroke and the exhaust rotary valve is rotated by one fourth to keep one of the exhaust rotary valve well holes in open condition to align with the cylinder in exhaust stroke, according to one embodiment herein.

FIG. 12 illustrates the cross sectional view of the piston engine showing the exhaust rotary valve with cylinder in exhaust stroke, wherein one of the exhaust rotary valve well hole is open according to one embodiment of the present disclosure. The exhaust rotary valve B like the intake rotary valve A consists of a pipe called exhaust rotary valve pipe 28 with exhaust rotary valve hole 15, 16, 17 and 18 that are drilled based on the valve timing and itself is connected to the exhaust rotary valve gear 30. The exhaust rotary valve B is located inside of the exhaust rotary valve well 29 that has exhaust rotary valve well holes 23, 24, 25 and 26 that are drilled on the top of the head cylinders 19, 20, 21 and 22 and are rotating. The exiting place of smoke from the engine is the exhaust port D. The exhaust rotary valve gears 30 has a diameter equivalent to the intake rotary valve gear 27 and are connected with it based on the valve timing. But the spindle gear 33 is not connected to them and rotation of each cycle of the exhaust rotary valve gear 30 is equivalent to one rotation of the intake rotary valve gear 27 and double amount of the crankshaft gear 34.

Therefore the exhaust rotary vale gear 30 indirectly receives the force for its movement from the intake rotary vale gear 27. According to FIG. 12 the piston 39 will come down and the cylinder 19 is at the intake stroke mode. The exhaust rotary valve hole 15 in its one fourth rotation is located after the exhaust stroke from completing the rotation of the exhaust rotary valve B and consequently the exhaust rotary valve well hole 23 is closed. The piston 40 is raised and the cylinder 20 is in the exhaust stroke mode. The exhaust rotary valve hole 16 is opposite to the exhaust rotary valve well hole 24 and consequently the path for exiting smoke is opened. The piston 41 is located at the bottom part and the cylinder 21 is at the power stroke stage. The exhaust rotary valve hole 17 is located at one fourth of its rotation before the exhaust stroke from completing the rotation of the exhaust rotary valve B and consequently the exhaust rotary valve well hole 25 is closed. The piston 42 is raised and the cylinder 22 is at the compression stroke stage. The exhaust rotary valve hole 18 is located at one second to its rotation before the exhaust stroke from completing the rotation of the exhaust rotary valve B and consequently the exhaust rotary valve well hole 26 is closed.

Figure 13:
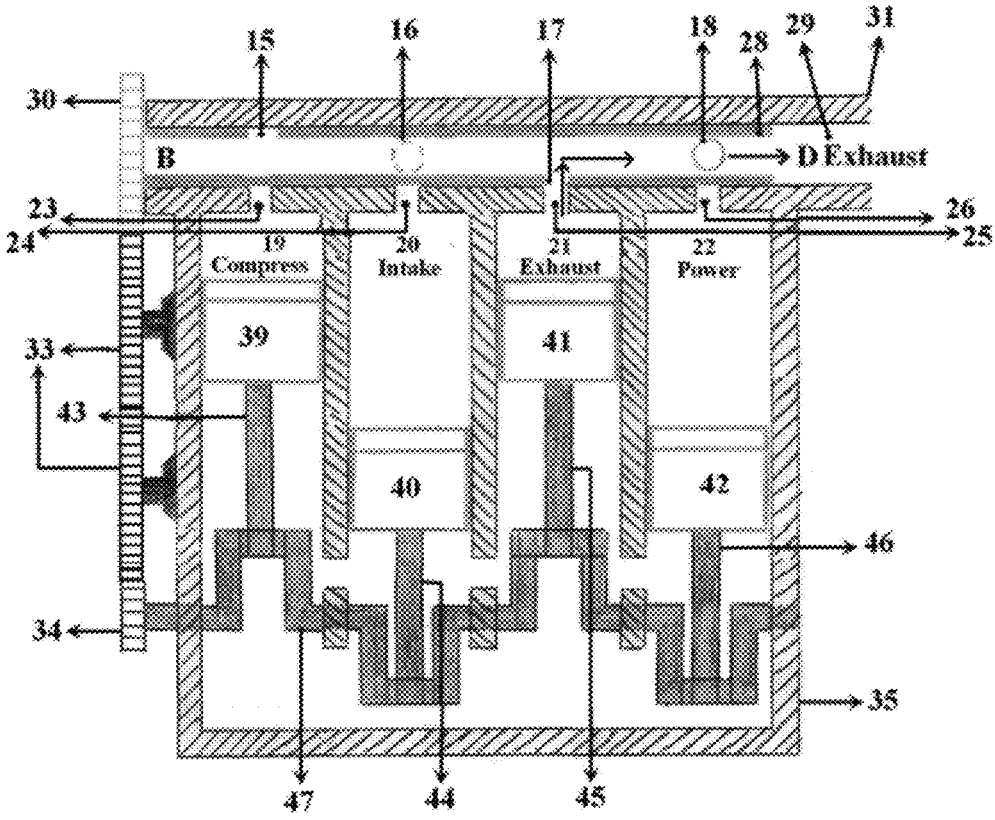
FIG. 13 illustrates a cross sectional view of a piston engine provided with a rotary valve system and the exhaust rotary valve, when another cylinder is in an exhaust stroke and the exhaust rotary valve is rotated by two fourth to keep one of the exhaust rotary valve well holes in open condition to align with the cylinder in exhaust stroke, according to one embodiment herein.

FIG. 13 illustrates the cross sectional view of the piston engine showing the exhaust rotary valve with cylinder in exhaust stroke, wherein one of the exhaust rotary valve well hole is open according to one embodiment of the present disclosure. FIG. 13 shows that the piston 39 is at the upper hand and the cylinder 19 is at the compression stroke and consequently the exhaust rotary valve hole 15 is located at one second of its rotation before the exhaust stroke and the exhaust stroke valve well hole 23 is closed. The piston 40 is located at one fourth of its rotation and after the exhaust stroke from completing the rotation of the exhaust rotary valve B and consequently the exhaust rotary valve well hole 24 is closed. The piston 41 is located at the top and the cylinder 21 is in the exhaust stroke and the exhaust rotary valve hole 17 is located opposite to the exhaust rotary valve well hole and the path for exiting smoke is opened. The piston 42 is located at the bottom part and the cylinder 22 is located at the power stroke. The exhaust rotary valve hole 18 is located at its one fourth rotation before the exhaust stroke from completing the rotation of the exhaust rotary valve B and the exhaust rotary valve well hole 26 is closed.

Figure 14:
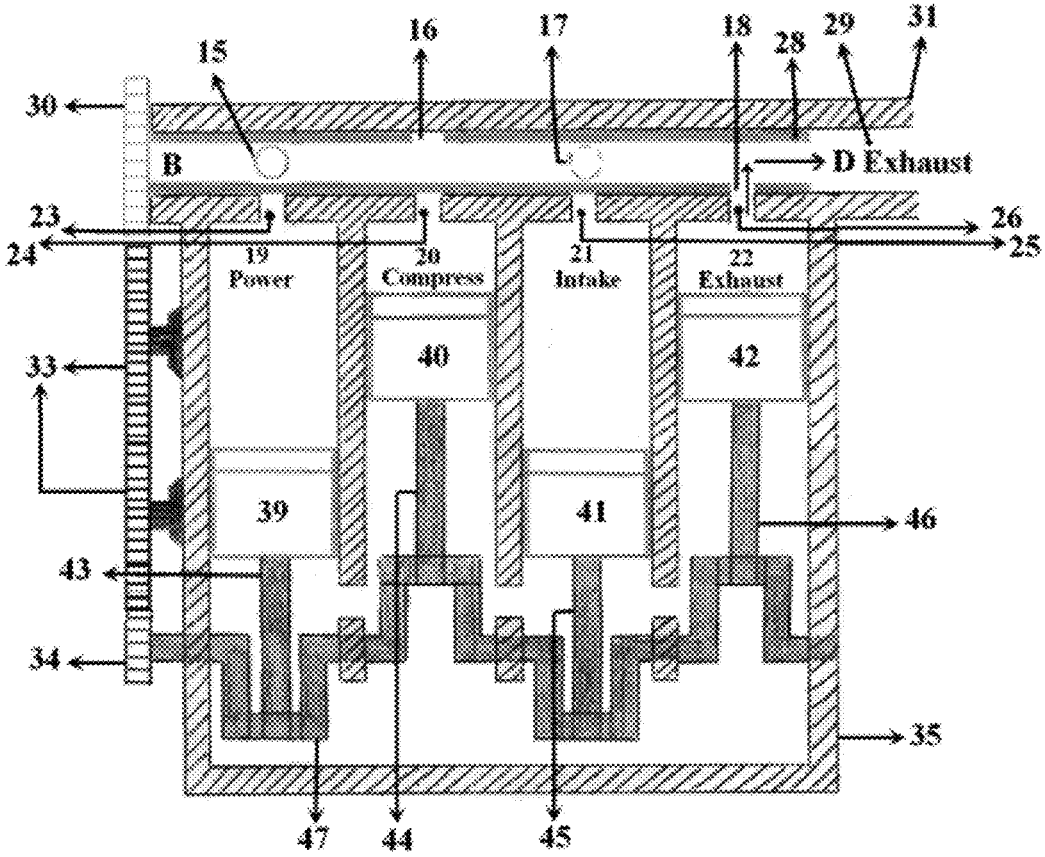
FIG. 14 illustrates a cross sectional view of the piston engine provided with a rotary valve system and the exhaust rotary valve, when another cylinder is in an exhaust stroke and the exhaust rotary valve is rotated by three fourth to keep one of the exhaust rotary valve well holes in open condition to align with the cylinder in exhaust stroke, according to one embodiment herein.

FIG. 14 illustrates the cross sectional view of the piston engine showing the exhaust rotary valve with cylinder in exhaust stroke, wherein one of the exhaust rotary valve well hole is open according to one embodiment of the present disclosure. In the FIG. 14, the piston 39 is located at the bottom and the cylinder 19 is located at the power stroke and the exhaust rotary valve hole 15 is located at its one fourth rotation before the exhaust stroke from completing the rotation of the exhaust rotary valve B and the exhaust rotary valve well hole 23 is closed. The piston 40 is located at the top and the cylinder 20 is at the compression stroke stage. The exhaust rotary valve hole 16 is at its one second rotation before the exhaust stroke from the completing the rotation of the exhaust rotary valve B and the exhaust rotary valve well hole 24 is closed. The piston 41 is located at the bottom part and the cylinder 21 is at the intake stroke. The exhaust rotary valve hole 17 is at its one fourth rotation after the exhaust stroke from completing the rotation of the exhaust rotary valve B and consequently the exhaust rotary valve well hole 25 is closed. The piston 24 is located at the top and the cylinder 22 is at the exhaust stroke. The exhaust rotary valve hole 18 is located opposite to the exhaust rotary valve well hole 26 and path for exiting smoke is opened.

Figure 15:
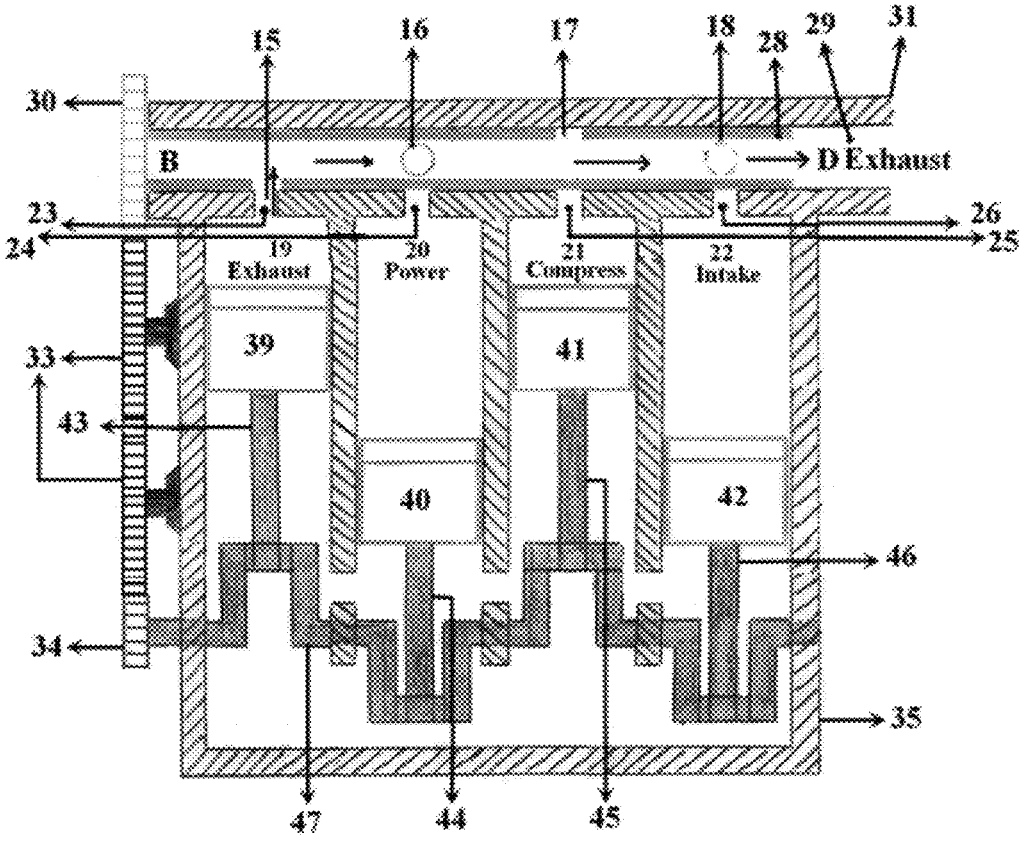
FIG. 15 illustrates a cross sectional view of the piston engine provided with a rotary valve system and the exhaust rotary valve, when another cylinder is in an exhaust stroke and the exhaust rotary valve is rotated by one cycle to keep one of the exhaust rotary valve well holes in open condition to align with the cylinder in exhaust stroke, according to one embodiment herein.

FIG. 15 illustrates the cross sectional view of the piston engine showing the exhaust rotary valve with cylinder in exhaust stroke, wherein one of the exhaust rotary valve well hole is open according to one embodiment of the present disclosure. In the FIG. 15, the piston 39 is located at the top and the cylinder 19 is in the exhaust stroke. The exhaust rotary valve hole 15 is located opposite to the exhaust rotary valve well hole 23 and the path for exiting smoke is opened. The piston 40 is located at the bottom part and the cylinder 20 is located at the power stroke. The exhaust rotary valve hole 16 is located at its one fourth rotation before the exhaust stroke from completing the rotation of the exhaust rotary valve B and consequently the exhaust rotary valve well hole 23 is closed. The piston 41 is located at the top and the cylinder 21 is located at the compression stroke. The exhaust rotary valve hole 17 is located at its one second rotation before the exhaust stroke from completing the rotation of exhaust rotary valve hole B and exhaust rotary valve well hole 25 is closed. The piston 42 is located at the bottom part and the cylinder 22 is at the intake stroke stage. The exhaust rotary valve hole 18 is located at its one fourth rotation after the exhaust stroke from completing the rotation of the exhaust rotary valve B and the exhaust rotary valve well hole 26 is closed.

The rotary valve system according to the embodiment of the present disclosure changes the stroke movement while opening and closing of the intake valve and the exhaust valve into rotating or circle movement, thereby reducing the shake in the engine. Besides the simplicity in design, the light weight equipments decrease the overall fuel consumption. According to the embodiments of the present disclosure, the level of entering fuel, the air and the exiting smoke can be changed, therefore it is possible to change the volume and the timing for entering the fuel, the air and exiting the smoke. It is also possible to change the operation of the system that can be performed in a specified range. It is also possible to design an independent engine or to change the present head cylinders with rotary valves of the present invention which considerably reduces the manufacturing cost. The development and production of the valve systems will be cheaper and faster.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A valve system for piston engines, the system comprising; an intake rotary valve, the intake rotary valve comprises; an intake rotary valve pipe; a plurality of intake rotary valve holes drilled in the intake rotary valve pipe along a length of the valve pipe; an intake rotary valve well; a plurality of intake rotary valve well holes provided in the intake rotary valve well; an injector pipe, wherein the injector pipe extending substantially concentrically within the intake rotary valve pipe, wherein the injector pipe includes a plurality of injector nozzles that extend into the intake well holes; and; wherein the intake rotary valve well is a lengthwise cavity drilled into a head cylinder of the piston engine and extending along the length of the pipe;

an exhaust rotary valve arranged in conjunction with the intake rotary valve;

a crankshaft gear; and a plurality of spindle gears; wherein the plurality of spindle gears are connected to at least one of the intake rotary valve and the exhaust rotary valve to transfer a rotary force from the crankshaft gear to at least one of the intake rotary valves and exhaust rotary valves such that intake rotary valve and the exhaust rotary valve are set in motion.

2. The valve system according to claim 1, wherein the plurality of the injector nozzles are arranged inside the plurality of intake rotary valve well holes at a predefined distance.

3. The valve system according to claim 1, wherein a diameter of the intake rotary valve gear is at least twice a diameter of the crankshaft gear.

4. The valve system according to claim 1, wherein the intake rotary valve pipe has a length equal to a length of the head cylinder.

5. The valve system according to claim 1, wherein the intake rotary valve pipe has a length different from the length of the head cylinder.

6. The valve system according to claim 1, wherein the intake rotary valve holes and the intake rotary valve well holes are arranged opposite to each other so as to facilitate entrance of at least one of a fuel and air into an open cylinder.

7. The valve system according to claim 1, wherein a half rotation of the crankshaft gear leads to one fourth rotation of the intake rotary valve gear.

8. The valve system according to claim 1, wherein the one fourth rotation of the intake rotary valve gear leads to completion of at least one of the four strokes of the piston engine.

9. The valve system according to claim 1, wherein the exhaust rotary valve comprises; an exhaust rotary valve pipe; a plurality of exhaust rotary valve holes provided inside the exhaust rotary valve pipe; an exhaust rotary valve well; and a plurality of exhaust rotary valve well holes provided inside the exhaust rotary valve well; wherein the exhaust rotary valve well is a lengthwise cavity drilled into a head cylinder of the piston engine and extending along the length of the pipe.

10. The valve system according to claim 9, wherein a diameter of the exhaust rotary valve gear is at least twice a diameter of the crankshaft gear.

11. The valve system according to claim 9, wherein the exhaust rotary valve pipe has a length equal to a length of the head cylinder.

12. The valve system according to claim 9, wherein the exhaust rotary valve pipe has a length different from the length of the head cylinder.

13. The valve system according to claim 9, wherein the angle of rotation of the exhaust rotary valve pipe is proportional to the angle of each exhaust rotary valve holes.

14. The valve system according to claim 9, wherein the exhaust rotary valves are arranged opposite to the exhaust rotary valve well holes for exiting smoke from the head cylinder.

15. The valve system according to claim 9, wherein a half rotation of the crankshaft gear equals one fourth rotation of the exhaust rotary valve gear.

16. The valve system according to claim 9, wherein the one fourth rotation of the exhaust rotary valve gear causes the completion of at-least one of the four stroke of the piston engine.

* * * * *